US006513574B2

(12) United States Patent
Sæther et al.

(10) Patent No.: US 6,513,574 B2
(45) Date of Patent: Feb. 4, 2003

(54) WATER COOLING SYSTEM FOR CONTINUOUS CASTING EQUIPMENT

(75) Inventors: Torstein Sæther, Sunndalsøra (NO); Leif Hektoen, Sunndalsøra (NO); Idar Kjetil Steen, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 09/862,467

(22) Filed: May 23, 2001

(65) Prior Publication Data

US 2002/0033246 A1 Mar. 21, 2002

(30) Foreign Application Priority Data

May 26, 2000 (NO) ..... 002723

(51) Int. Cl.[7] ..... B22D 11/049; B22D 11/055
(52) U.S. Cl. ..... 164/444; 164/487
(58) Field of Search ..... 164/444, 487

(56) References Cited

U.S. PATENT DOCUMENTS 4,597,432 A * 7/1986 Collins et al. ..... 164/348
5,685,359 A * 11/1997 Wagstaff et al. ..... 164/444

* cited by examiner

*Primary Examiner*—Kuang Y. Lin
(74) *Attorney, Agent, or Firm*—Wenderoth, Lind & Ponack, L.L.P.

(57) ABSTRACT

Device in connection with a water-cooling system for direct chill semi-continuous casting equipment for casting metal, in particular casting aluminium ingots (14). The solution comprises one or more chills (9) arranged in a frame structure with an integral water distribution box (18). The chill(s) comprise(s) a mould chamber surrounded by permeable wall elements (10) for the supply of oil and/or gas and is(are) open at the top with an opening (13) for the supply of molten metal and, at the start of each casting operation, is(are) closed at the bottom by means of a mobile support. The metal is cooled in two stages, by primary cooling in the mould chamber and secondary cooling by direct water cooling immediately below the primary cooling area. A separate cooling circuit called the recooling circuit is arranged to cool the chills after the end of the casting cycle. The recooling (1, 2, 3) and secondary cooling (11, 19) thus consist of two separate cooling circuits. The recooling circuit comprises one or more cooling ducts (3) in the chill wall with supply and outflow pipe systems (1 and 2). The secondary cooling circuit comprises a water distribution chamber (11) which is connected to all the chills (9) of the equipment and which distributes water to drilled holes or a water distribution slit (19) around the circumference of the chill.

13 Claims, 3 Drawing Sheets

WATER COOLING SYSTEM FOR CONTINUOUS CASTING EQUIPMENT

The present invention concerns a water-cooling system for direct chill semi-continuous casting equipment for casting metal.

Casting equipment of the above type for casting circular aluminium ingots comprises a large number of chills arranged in rows in a frame structure. Molten metal is supplied to the chills via a metal manifold through a hot-top from above and to the mould chamber in each chill. The metal is cooled and hardened in two stages. Stage 1 is called primary cooling in which the initial hardening of the metal is achieved by cooling through the wall of the mould chamber of the chill. Stage 2 is called secondary cooling in which water immediately below the primary cooling area is sprayed directly against the metal via a water gap or holes along the circumference of the chill. A movable support under each chill moves downwards as the metal hardens so that a long body, a circular ingot, is formed which may have different diameters depending on the purpose for which it is intended.

The cooling in the primary area in the chill is brought about by water, which, in accordance with a prior art technique, is also used for secondary cooling, first circulating through a chamber on the outside of the mould chamber. This chamber is formed by assembling chill elements with intermediate seals. Even if, when assembling the casting equipment, great efforts are made to ensure a good seal, leakages may still occur over time on account of material failure or incorrect assembly. If water comes into contact with molten metal, explosions may occur in the worst case scenario. This may result in serious damage or injury.

Another disadvantage of prior art equipment of this type is that, after each casting operation, the cooling water must be circulated through the secondary cooling circuit in the chills for a while in order to cool (recool) the chills and thus prevent thermal damage to the seals and other equipment components such as wall elements. During the time it takes to cool the casting equipment after casting, the cast rods cannot be removed from the equipment, which, in turn, results in an unnecessary delay before the next casting operation can begin and thus makes the casting equipment less efficient.

U.S. Pat. No. 4,597,432 shows and describes equipment of the above type in which any leaked water is drained upwards towards the top of the frame structure of the chills and out over the side of it. Although there is a certain distance from the top of the frame structure up to the melt in the metal distribution channel, this solution represents a not inconsiderable risk of accidents in connection with water splashes near the melt.

Moreover, the solution does not have a warning system for leaks or a solution for the elimination of the delay between casting operations.

The present invention represents casting equipment which is considerably improved in terms of safety, which is more efficient and which is easy and inexpensive to produce.

The present invention is characterised by the features defined in the characterising parts of the attached independent claims 1 and 3.

The dependent claims 2, 4 and 5 indicate the advantageous features of the present invention.

The present invention will be described in further detail in the following using examples and with reference to the attached drawings, where:

Figure 1:
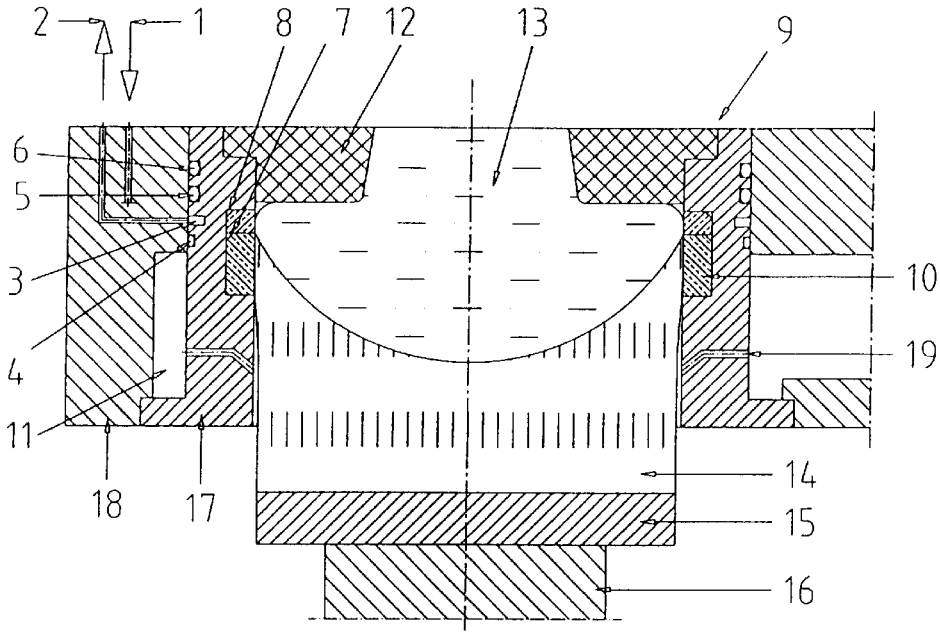
FIG. 1 shows a cross-section of a chill for the production of ingots.
Figure 2:
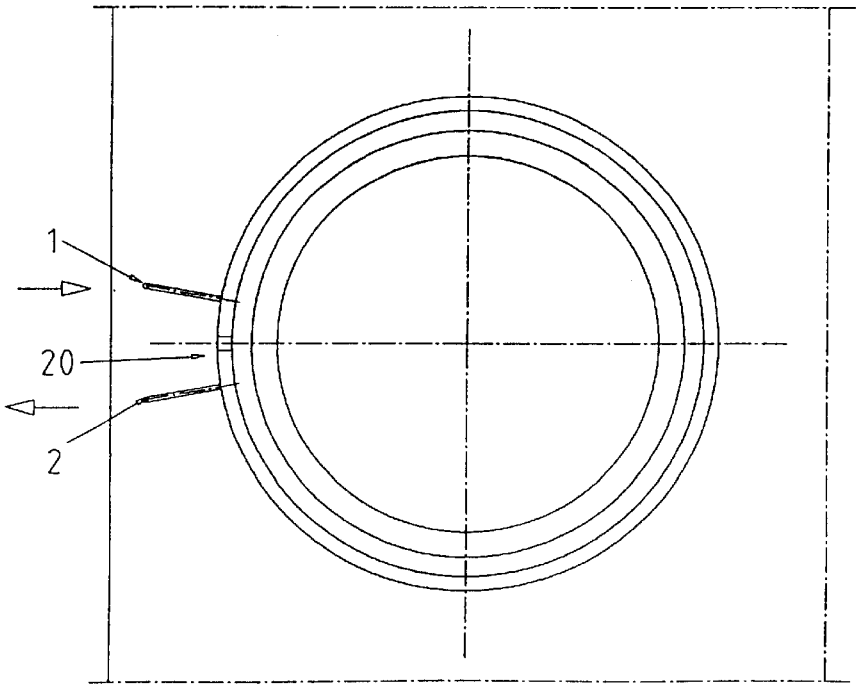
FIG. 2 shows the same chill seen from above.
Figure 3:
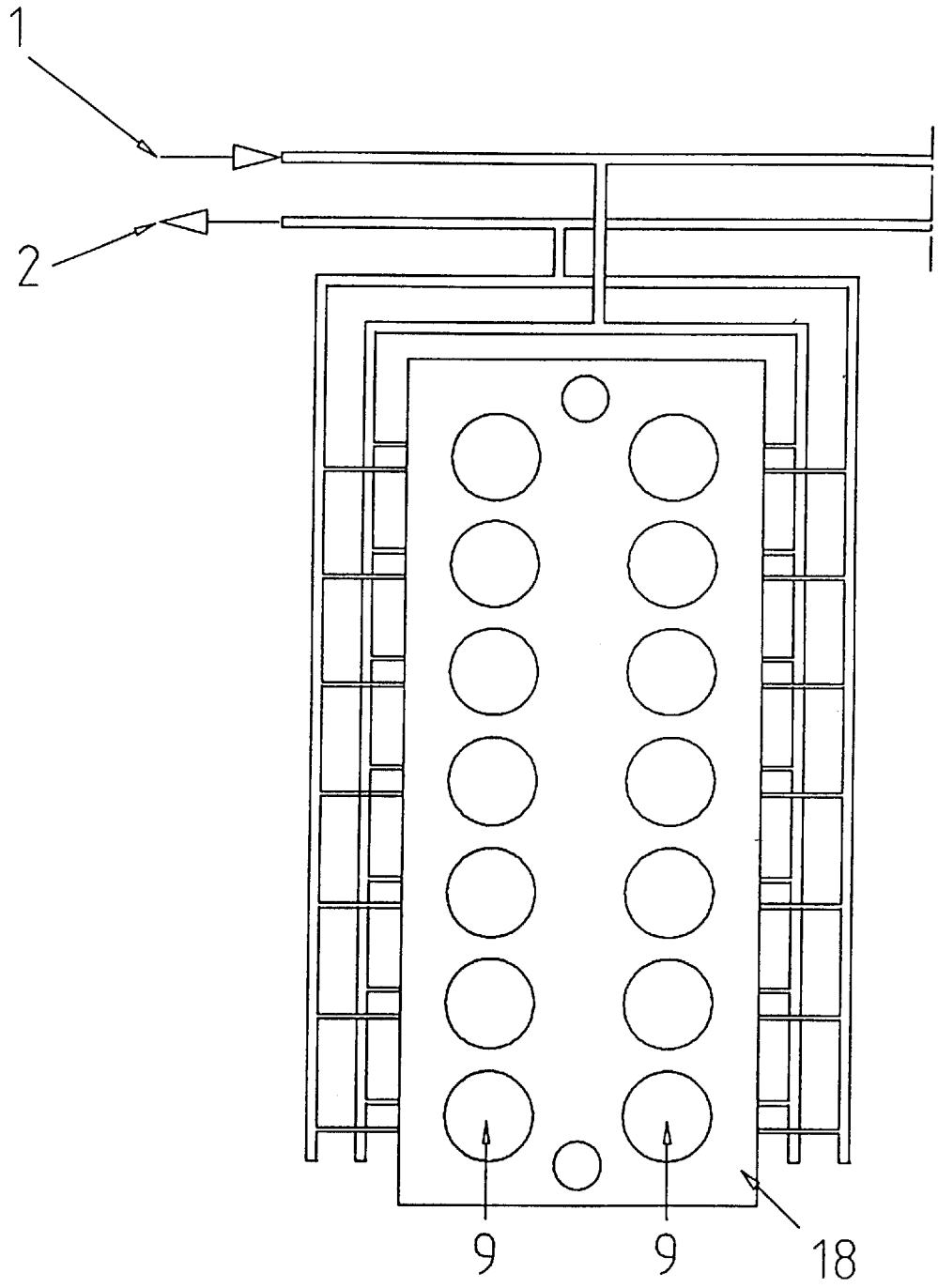
FIG. 3 shows a simplified sketch of casting equipment with chills arranged in two rows with a pipe distribution network for water inflow and outflow in accordance with the present invention.
Figure 4:
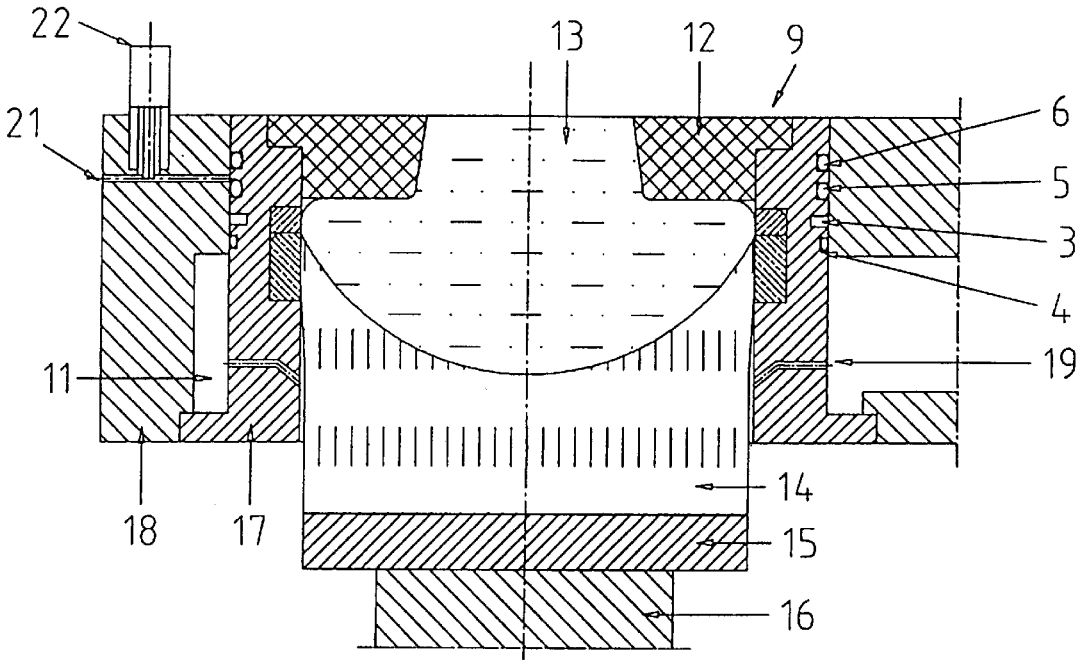
FIG. 4 shows a cross-section of the same chill as shown in FIG. 1 but with drainage and warning arrangements in accordance with the present invention.

Casting equipment for the production of aluminium ingots 14 comprises, as stated in the introduction, a number of chills 9 arranged in a frame structure 18, see FIG. 3. Each chill 9 comprises, as shown in FIGS. 1 and 4, an upward-facing open inlet for molten metal 13 with a hot-top 12 of heat-resistant, insulating material, a mould chamber formed by a chill wall 17 with permeable wall elements 10 for the supply of oil and/or gas and a mobile support 15, 16.

Cooling and hardening of the metal take place in two stages, by primary cooling against the chill wall, i.e. the porous elements 10 at the top of the mould chamber, and by secondary cooling at the bottom of the chill by directly spraying water via drilled holes or a slit 19 around the circumference of the chill.

The cooling in the primary cooling circuit is achieved by cooling with water which circulates through a chamber 11 on the outside of the chill 17 and which flows on through the slit/drilled holes 19 and thus constitutes the cooling water which is sprayed directly onto the metal in the secondary cooling stage. The chamber 11 is formed in an intermediate space between the chill wall 17 and a water distribution box 18 which constitutes an integral part of the frame structure for the casting equipment and which is common to all the chills.

One of the special features of the present invention is that a recooling circuit 20 is arranged in connection with each of the chills 17. It is used to cool the chills 17 after each casting operation. Water is supplied through a pipe distribution system 1 (see also FIG. 3) to a cooling duct 3 on the outside of each chill wall and on back through a pipe collection system 2.

With such a separate recooling circuit, the chills, seals and wall elements can be rapidly cooled after casting regardless of the secondary cooling circuit. This means that the chill section(s) can be removed from the casting tank so that there is access to lift out the cast workpieces immediately after casting has been completed. This means that the delay between each casting operation is minimised, thus increasing the casting efficiency and capacity of the equipment considerably.

The casting takes place by the molten metal being supplied from above, via a distribution system for the chills (not shown), through the opening 13 in the chill 9, while the support 15, 16 moves downwards. The metal starts to harden against the wall surface, i.e. the permeable elements 10, and gradually hardens completely when water is sprayed against the metal via the secondary cooling circuit 19. This produces a cast, long metal body 14. When the support 15, 16 has reached its lower level, the recooling in the recooling circuit 20 starts and the cast ingot is removed so that the support can be returned to its starting position, in which it forms a tight seal against the chill, ready for the next casting operation. With several chills arranged in a row as shown in FIG. 3, several rods are cast simultaneously in each casting operation.

As mentioned in the introduction, there is a risk that water leakage from the chills can result into water coming into contact with molten metal. In the worst case scenario this can lead to an explosion with serious injury to people and irreparable damage to equipment.

In order to avoid such leakage, a double set of sealing rings 5, 6, preferably O-rings, are arranged above the recooling circuit 3, as shown in FIG. 4. Between these rings there is a drilled hole 21 for each chill, which will lead any water out through the water distribution box wall and directly out to the side of the frame structure of the casting equipment. The upper sealing ring 6 ensures that no water flows up to the top of the frame structure. In connection with the drilled hole 21, there is also a resistive sensor or another type of sensor 22 which will register any water which flows out through the drilled hole 21. The resistive sensor 22 may expediently be connected to a sound or light alarm (not shown) so that operators of the equipment can be warned and the casting operation stopped in the event of any leakage.

One sensor may expediently be installed for each chill (FIG. 4) or there may be one sensor for each row of chills with the sensor connected to the chills via a common connection pipe (not shown).

When one sensor is used for each chill, it will be easy to arrange a warning system with, for example, an illuminated panel with a light connected to each chill to show the chill in which any water leakage occurs.

What is claimed is:

1. A cooling system for direct chill semi-continuous casting equipment for casting metal, said system comprising:

a frame structure having an integral cooling fluid distribution box;

at least one mold positioned in said frame structure, said mold comprising a mold wall defining a mold chamber, an open top for receiving a supply of molten metal, a plurality of permeable wall elements provided in said mold wall for supplying oil and/or gas, a fluid passage formed in the mold wall below said permeable wall elements, and a movable support for closing a bottom of said mold wall at a start of a casting operation, wherein the metal in said mold chamber can be cooled in a primary cooling stage via a cooling chamber, and in a secondary cooling stage via said fluid passage; and a recooling circuit, arranged separately from said mold, comprising at least one cooling duct formed between said distribution box and said mold wall, a supply pipe system for supplying a cooling fluid to said cooling duct, and an outflow pipe system for draining the cooling fluid from said cooling duct.

2. The cooling system claimed in claim 1, wherein said cooling duct is defined by an inner peripheral surface of said distribution box and an outer peripheral surface of said mold wall.

3. The cooling system claimed in claim 1, wherein said cooling duct is formed by a recess formed in an inner peripheral surface of said distribution box or an outer peripheral surface of said mold wall.

4. The cooling system claimed in claim 1, wherein said cooling chamber is located between said distribution box and said mold wall, and said cooling chamber is in communication with said fluid passage so that cooling fluid can be supplied from said cooling chamber directly to the metal via said fluid passage.

5. The cooling system claimed in claim 4, wherein said cooling chamber is formed by a recess in an inner peripheral surface of said distribution box or an outer peripheral surface of said mold wall.

6. The cooling system claimed in claim 5, wherein said fluid passage comprises a plurality of holes or at least one slit extending through said mold wall.

7. The cooling system claimed in claim 1, further comprising a plurality of molds arranged in said frame structure.

8. The cooling system claimed in claim 1, wherein the equipment is adapted to cast aluminium ingots.

9. A cooling system for direct chill semi-continuous casting equipment for casting metal, said system comprising:

a frame structure having an integral cooling fluid distribution box;

at least one mold positioned in said frame structure, said mold comprising a mold wall defining a mold chamber, an open top for receiving a supply of molten metal, a plurality of permeable wall elements provided in said mold wall for supplying oil and/or gas, a fluid passage formed in the mold wall below said permeable wall elements, and a movable support for closing a bottom of said mold wall at a start of a casting operation;

at least one recooling duct between said distribution box and said mold wall;

a primary cooling chamber between said distribution box and said mold wall, wherein said primary cooling chamber is in communication with said fluid passage so that the metal in said mold chamber can be cooled in a primary cooling stage via said primary cooling chamber, and in a secondary cooling stage via said fluid passage;

two sealing rings disposed between said distribution box and said mold wall in an area above said recooling duct and/or said primary cooling chamber; and a through hole extending from an outer surface of said distribution box to an area between said sealing rings, wherein said through hole is adapted to lead cooling fluid that has leaked past one of said sealing rings outside of said distribution box.

10. The cooling system claimed in claim 9, further comprising a sensor for detecting the presence of water in said through hole, wherein said sensor is connected to a light or an audible alarm for indicating a detected leak.

11. The cooling system claimed in claim 10, further comprising a plurality of molds arranged in said frame structure.

12. The cooling system claimed in claim 11, wherein a plurality of said sensors are installed so that each mold is associated with one of said sensors.

13. The cooling system claimed in claim 9, wherein the equipment is adapted to cast aluminium ingots.

* * * * *